US011330942B1

(12) United States Patent
Bergman et al.

(10) Patent No.: US 11,330,942 B1
(45) Date of Patent: May 17, 2022

(54) TOILET TRAINER ASSEMBLY

(71) Applicants: Judah Bergman, Lakewood, NJ (US); Yishak Sultan, West Long Branch, NJ (US); Jiaxuan Ma, Lakewood, NJ (US)

(72) Inventors: Judah Bergman, Lakewood, NJ (US); Yishak Sultan, West Long Branch, NJ (US); Jiaxuan Ma, Lakewood, NJ (US)

(73) Assignee: Jool Products LLC, Lakewood, NJ (US)

( * ) Notice: Subject to any disclaimer, the term of this patent is extended or adjusted under 35 U.S.C. 154(b) by 0 days.

(21) Appl. No.: 17/215,342

(22) Filed: Mar. 29, 2021

(51) Int. Cl.
*A47K 11/04* (2006.01)

(52) U.S. Cl.
CPC ..... *A47K 11/04* (2013.01)

(58) Field of Classification Search
CPC ..... A47K 11/04; A47K 11/06
USPC ..... 4/483
See application file for complete search history.

(56) References Cited

U.S. PATENT DOCUMENTS 6,038,711 A * 3/2000 Clarke ..... G09B 19/0076 4/449
2014/0007335 A1* 1/2014 Ukaegbu ..... A47K 11/04 4/300
2014/0259354 A1* 9/2014 Sundberg ..... A47K 13/00 4/483
2018/0247564 A1* 8/2018 Decker ..... A47K 11/06
2019/0021560 A1* 1/2019 Del Duke ..... A47K 17/028

* cited by examiner

*Primary Examiner* — Huyen D Le
(74) *Attorney, Agent, or Firm* — Christopher Pilling

(57) ABSTRACT

A toilet trainer assembly is provided, having components which compactly fit together efficiently for shipping and stowing while also providing an improved experience for a child during use. The toilet trainer features a base member, a toilet seat, and a compartment which resembles a traditional toilet tank. The base member provides a hollow interior configured to be sized and shaped to fit the compartment and the toilet seat within when stowed. A flush mechanism provided on the toilet tank is configured to produce various sounds when activated.

14 Claims, 4 Drawing Sheets

TOILET TRAINER ASSEMBLY

CROSS-REFERENCE TO RELATED APPLICATIONS

N/A

BACKGROUND OF THE INVENTION

1. Field of the Invention

The present invention relates generally to toilet seats, and more particularly to an improved toilet trainer assembly.

2. Description of Related Art

Infants and children encounter numerous difficulties when using conventional toilet seats which are of a size to accommodate adult users. As known in the art, various types of children's toilet seats and toilet trainers have been developed to provide the infant or child with his own toilet seat having smaller dimensions than that of the adult toilet seat. However, there is room for improvement in this field. Consequently, an improved toilet trainer assembly is provided.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

It is one object of the present invention to provide toilet trainer assembly, having components which compactly fit together efficiently for shipping and stowing. It is another object of the invention to provide an improved experience for a child during use.

In order to do so, a toilet trainer is provided, the toilet trainer comprising a base member having a first bowl portion, a second bowl portion, and a rear portion; a toilet seat; a compartment; and, wherein the first bowl portion and the rear portion in combination provides a hollow interior configured to be sized and shaped to fit the entirety of the compartment and the entirety or approximately the entirety of the toilet seat within the hollow interior which defines a stowed position of the toilet trainer.

In one embodiment, the toilet seat is configured to rest on a rim of a top portion of the second bowl portion defining an installed position. In one embodiment, a perimeter edge of the base member is in contact with a ground surface in the installed position. In another embodiment, the perimeter edge spans the perimeter of the first bowl portion and the rear portion.

In one embodiment, a bottom portion of the toilet seat comprises contoured material configured to aid in the stability of the toilet seat in the installed position. In another embodiment, the contoured material includes a tab configured to be inserted into a cavity on the second bowl portion. In one embodiment, a removable bowl is provided, wherein the removable bowl is configured to be positioned in an interior of the second bowl portion.

In one embodiment, the compartment comprises an interior location to store items. In one embodiment, the compartment comprises an extendable rod configured to hold a roll of toilet tissue. In another embodiment, a flush mechanism having speakers configured to produces sounds is provided. In one embodiment, a flush mechanism is positioned within the compartment. In one embodiment, the toilet seat is removable from the installed position, such that the toilet seat may be used in conjunction with an adult toilet seat. In one embodiment, the toilet seat includes a pair of handles. In yet another embodiment, the toilet seat includes a removable cushion.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide an improved toilet trainer assembly.

For the purpose of this disclosure, the word "a" is defined to mean "at least one." The term "about" or "approximately" refers to a range of values within plus or minus 10% of the specified number or limitation. The term "substantially" means that the actual value is within about 10% of the actual desired value, particularly within about 5% of the actual desired value and especially within about 1% of the actual desired value of any variable, element or limit set forth herein. Unless otherwise defined, all technical terms used herein have the same meaning as commonly understood by one of ordinary skill in the art to which this disclosure belongs.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

Figure 1:
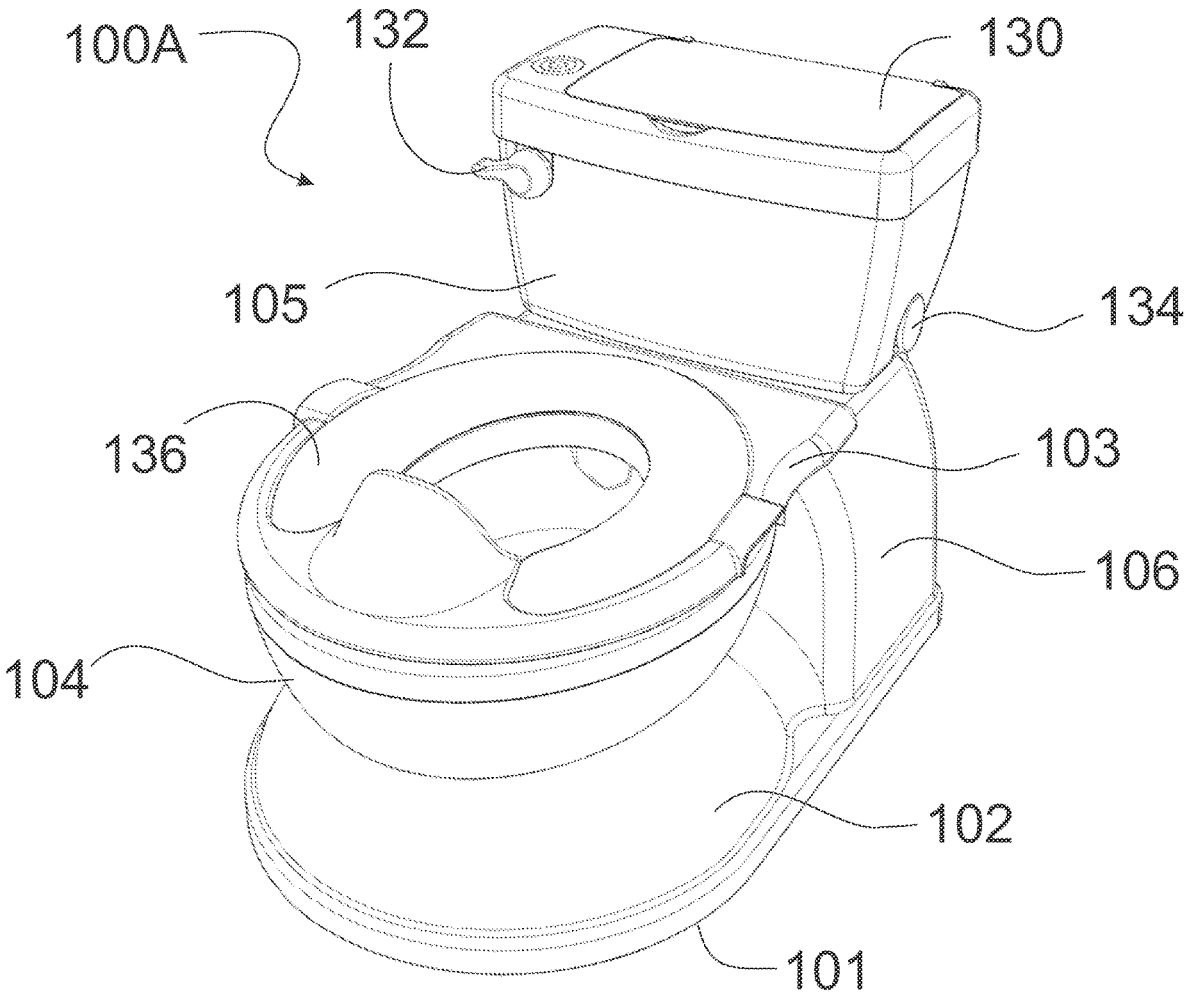
FIG. 1 is a perspective view of an improved toilet trainer assembly shown in an installed position according to an embodiment of the present invention.
Figure 2:
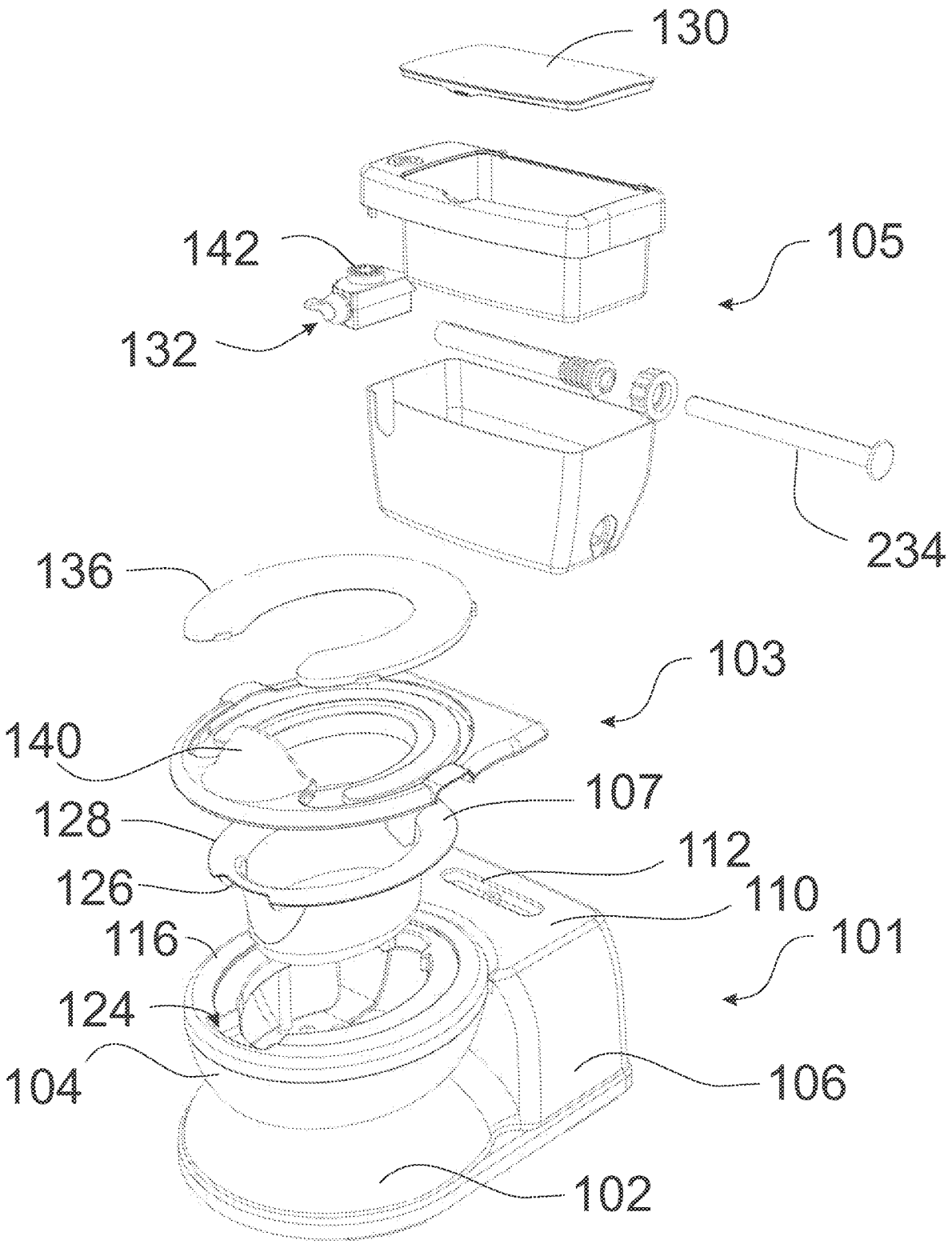
FIG. 2 is an exploded perspective view of the improved toilet trainer assembly shown in the installed position according to an embodiment of the present invention.

Referring now to FIGS. 1-2, the improved toilet trainer assembly 100 is shown in an installed position A. In one embodiment, the improved toilet trainer assembly includes a base member 101, a toilet seat 103, and a compartment 105. In some embodiment, the assembly includes a removable bowl 107. In one embodiment, the base member 101 includes a first bowl portion 102, a second bowl portion 104, and a rear portion 106.

Figure 4:
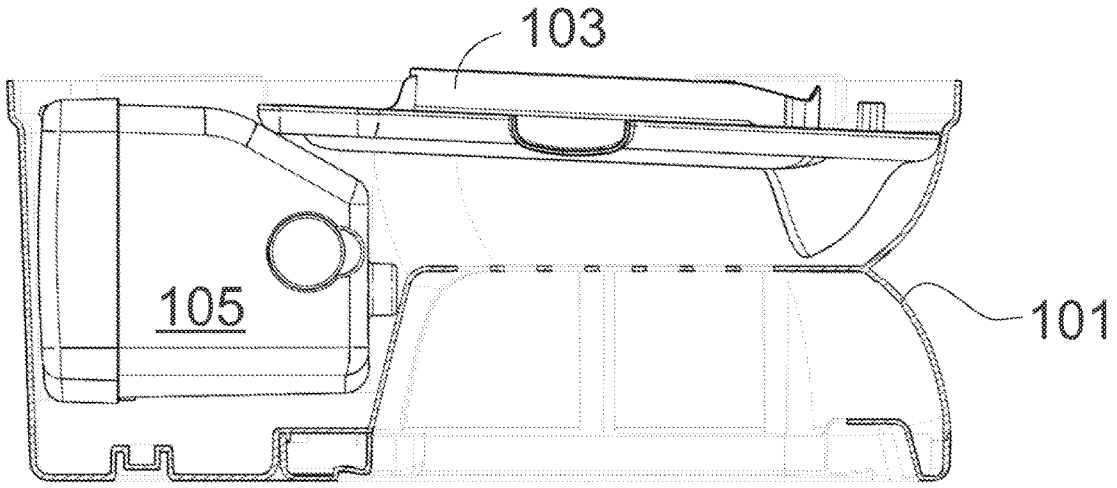
FIG. 4 is a side wireframe view of the improved toilet trainer assembly shown in the stowed position according to an embodiment of the present invention; and, FIG. 5 is a top wireframe view of the improved toilet trainer assembly shown in the stowed position according to an embodiment of the present invention.
Figure 5:
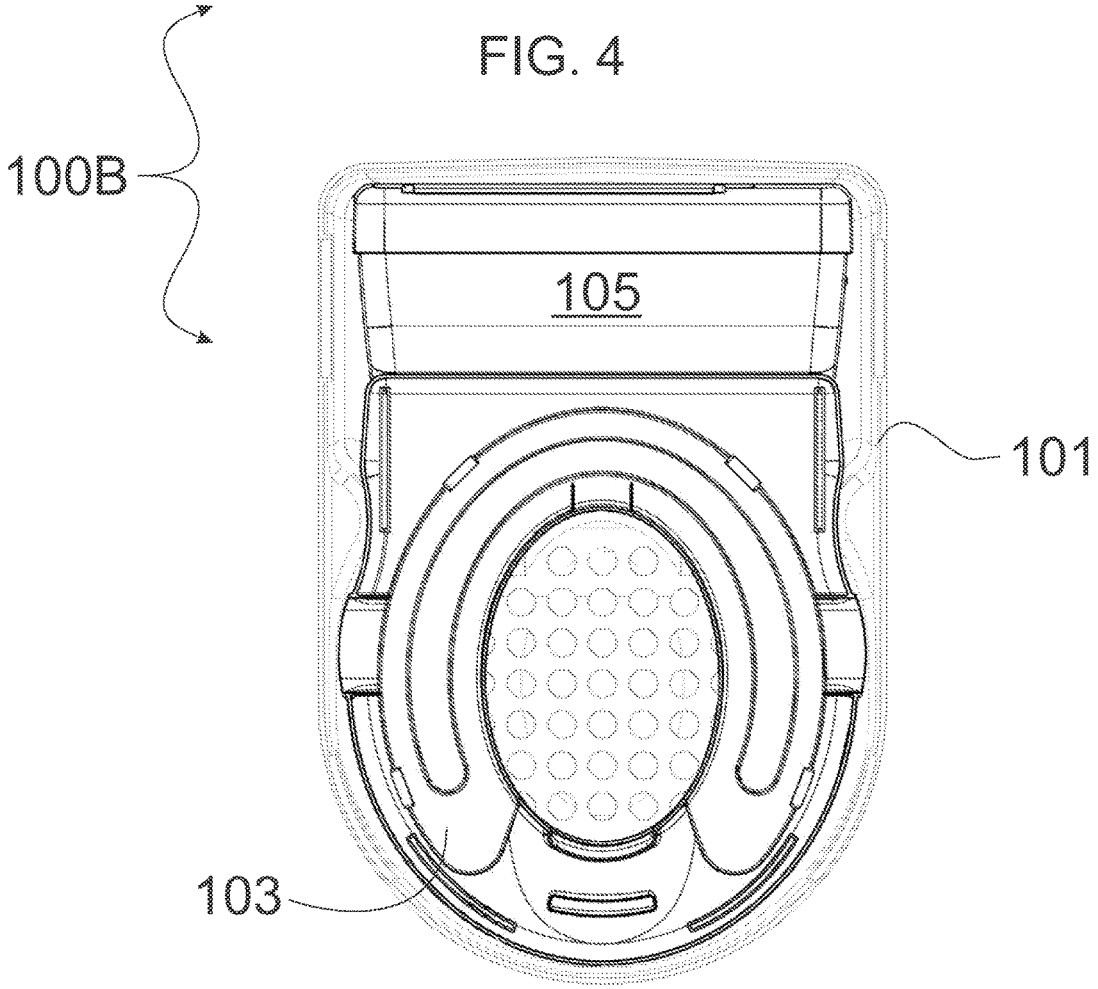

Advantageously, all the portions of the base member 101 include dual functionality. For example, the first bowl portion and the rear portion in combination provides the support for the entire assembly as shown in FIG. 1, while also providing at least a portion of a hollow interior 108 configured to be sized and shaped to fit to the entirety of the compartment 105, as well as the entirety or approximately the entirety of the toilet seat 103 as shown in FIGS. 4-5.

In some embodiments, a top portion 110 of the rear portion 106 includes a recess 112 matching the shape and size of a protrusion 114 positioned on a bottom side of the compartment 105. The combination of the recess 112 and the protrusion 114 provides stability to the compartment 105 in the installed positioned. In some embodiments, mounting hardware (not shown) may be used to further secure the compartment 105 in installed position.

In some embodiments, the toilet seat 103 is configured to rest on a rim 116 of a top portion of the second bowl portion 104. In some embodiments, a bottom surface 118 of the toilet seat 103 includes contoured material 120 configured to aid in the stability of the toilet seat in the installed position. More specifically, in some embodiments, the contoured material 120 includes a tab 122 configured to be inserted into cavity 114. In one embodiment, the cavity 144 is a combination of a first cutout 124 on rim 116 of the second bowl portion 104 and a second cutout 126 on a flange portion 128 of the removable bowl 107.

In some embodiments, the removable bowl is configured to be positioned in an interior of the second bowl portion 104. The removable bowl enables easy and efficient cleaning practices as well known in the art. Further, the removable bowl is configured to enable optional disposable and absorbent liners to catch any waste during use. In addition, the contoured material 120 is sized to fit and abut an inside surface of the removable bowl for stability of the toilet seat 103 during use.

In the installed position, the base is in a first orientation, which is defined as the first bowl portion 102 positioned on the bottom of the assembly, approximate to the ground. In one embodiment, a perimeter edge 110 of the base member 101 is in contact with a ground surface in the installed position 100A, wherein the perimeter edge spans an entire perimeter of the first bowl portion 102 and the rear portion 106.

Figure 3:
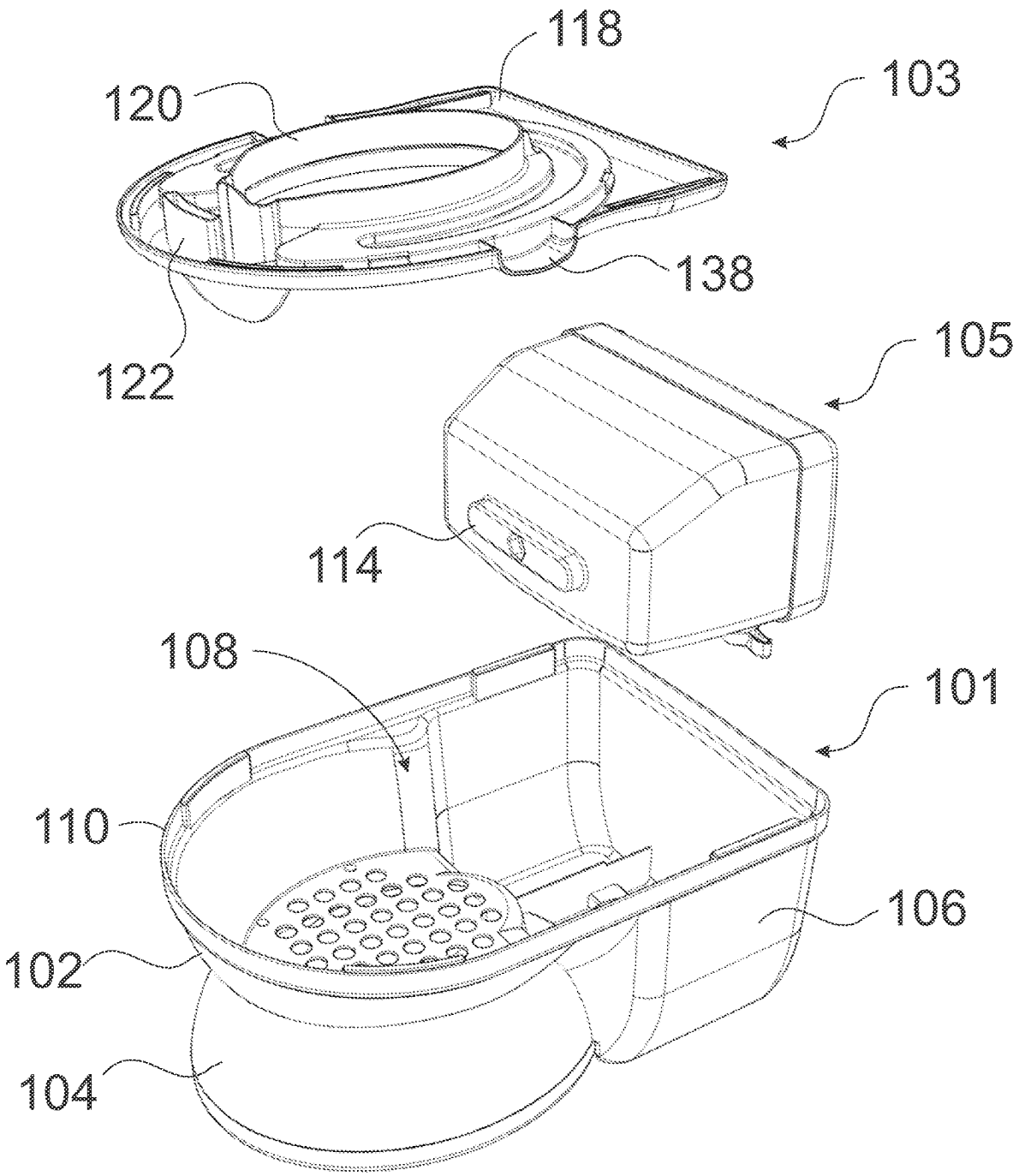
FIG. 3 is an exploded perspective view of the improved toilet trainer assembly shown in a stowed position according to an embodiment of the present invention.

Best seen in FIGS. 3-5, the stowed position B, the base is in a second orientation, which is defined as the first bowl portion 102 being reversed or in a flipped position, enabling the compartment 105 and the toilet seat 103 to fit in the hollow interior 108. In some embodiments, the compartment 105 is in the rear portion 106, and the toilet seat 103 is in the first bowl portion 102. Compared to the prior art, this vastly reduces the overall volume of the components of the assembly which is advantageous when storing the toilet trainer or shipping the toilet trainer. A small footprint saves packaging, reduces the shipping costs, and provides a means to stow the toilet trainer efficiently when not in use or during travel.

Advantageously, the footprint of the toilet trainer in the stowed position is equal to the outer dimensions of the base member 101 or perimeter edge 142. In one embodiment, the base member 101 is approximately 11 inches in both length and width, with a height of less than 7 inches. It should be understood, the dimensions of the base member 101 may vary, as long as the components fit within the base member as defined herein, which is a requirement of the invention.

The compartment 105 provides several advantages. First, it provides an interior location to store useful items to be used in conjunction with the toilet trainer. Useful items may include, but are not limited to, toilet tissue, diapers, pull-ups, briefs, clothing, and baby wipes, as well as sanitary wipes, sprays, lotions, and gels. Second, it resembles the appearance of a typical toilet tank one might find on as part of an adult toilet, which helps the child in the toilet training process. A lid 130 provides access to the interior location. Third, the compartment includes a flush mechanism 132, wherein the flush mechanism mechanically pivots as known in the art. In one embodiment, the flush mechanism produces sounds from internal speakers 142 wherein the sounds, by non-limiting example, include the sounds of a toilet flushing, and the sounds of encouragements, such as cheering, clapping, or a combination thereof.

In some embodiments, an extendable rod 134 is provided on the compartment 105, wherein the extendable rod 134 is configured to be stowed within the interior of the compartment 105, and be extracted to retain a roll of toilet tissue during use.

Although, in some embodiments, the majority of components are constructed of plastic, the materials may vary. In some embodiments, the toilet seat 103 comprises a cushion 136 providing padding and comfort for the child while seated, useful for long periods during the toilet training process. As the toilet seat 103 is easily removable, it can also be used with an adult toilet seat (not shown), as well known in the art. Other features include handles 138 and an integral splash guard 140, wherein the handles 138 provide an ease of handling while transporting the toilet seat 103 and when removing the toilet seat 103 from the assembly 100A or the adult toilet seat.

In some embodiments, rubber, textures, or non-slip materials may be provided at various locations, such as on the base member 101 as well as on the cushion for greater stability and safety. In some embodiments, the cushion 136 is removable for cleaning and replacements.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

What is claimed is:

1. A toilet trainer comprising:

a base member having a first bowl portion, a second bowl portion, and a rear portion;

a toilet seat;

a compartment; and, wherein the first bowl portion and the rear portion in combination provides a hollow interior configured to be sized and shaped to fit the entirety of the compartment and the entirety or approximately the entirety of the toilet seat within the hollow interior defining a stowed position.

2. The toilet trainer of claim 1, wherein the toilet seat is configured to rest on a rim of a top portion of the second bowl portion defining an installed position.

3. The toilet trainer of claim 2, wherein a perimeter edge of the base member is in contact with a ground surface in the installed position.

4. The toilet trainer of claim 3, wherein the perimeter edge spans the perimeter of the first bowl portion and the rear portion.

5. The toilet trainer of claim 2, a bottom surface of the toilet seat comprises contoured material configured to aid in the stability of the toilet seat in the installed position.

6. The toilet trainer of claim 5, wherein the contoured material includes a tab configured to be inserted into a cavity on the second bowl portion.

7. The toilet trainer of claim 2, further comprising a removable bowl, wherein the removable bowl is configured to be positioned in an interior of the second bowl portion.

8. The toilet trainer of claim 1, wherein the compartment comprises an interior location to store items.

9. The toilet trainer of claim 1, wherein the compartment comprises an extendable rod configured to hold a roll of toilet tissue.

10. The toilet trainer of claim 1, further providing a flush mechanism having speakers configured to produce sounds.

11. The toilet trainer of claim 1, wherein flush mechanism is positioned within the compartment.

12. The toilet trainer of claim 1, wherein the toilet seat is removable, such that the toilet seat may be used in conjunction with an adult toilet seat.

13. The toilet trainer of claim 1, wherein the toilet seat includes a pair of handles.

14. The toilet trainer of claim 1, wherein the toilet seat includes a removable cushion.

* * * * *